US008469775B2

(12) United States Patent
Dow et al.

(10) Patent No.: US 8,469,775 B2
(45) Date of Patent: Jun. 25, 2013

(54) CONVERSION ASSEMBLAGE ADAPTABLE FOR USE IN COMBINATION WITH A SURFACE MODIFYING APPARATUS AND METHOD THEREOF

(75) Inventors: David R. Dow, West Lakeland, MN (US); Allen J. Rivard, White Bear Lake, MN (US); John G. Petersen, Center City, MN (US); Galen A. Fitzel, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1029 days.

(21) Appl. No.: 12/411,817

(22) Filed: Mar. 26, 2009

(65) Prior Publication Data

US 2010/0009609 A1 Jan. 14, 2010

Related U.S. Application Data

(63) Continuation-in-part of application No. 12/258,901, filed on Oct. 27, 2008, now abandoned, which is a continuation-in-part of application No. 12/170,949, filed on Jul. 10, 2008, now abandoned.

(51) Int. Cl.
*B24B 27/08* (2006.01)

(52) U.S. Cl.
USPC ..... 451/59; 451/344; 451/354; 451/512; 451/523; 451/525

(58) Field of Classification Search
USPC ..... 451/59, 344, 354, 490, 512, 513, 451/514, 523, 525, 526
See application file for complete search history.

(56) References Cited

U.S. PATENT DOCUMENTS

| | | | |
|---|---|---|---|
| 450,378 | A | 4/1891 | Robinson |
| 1,417,598 | A | 5/1922 | George |
| 1,710,308 | A | 4/1929 | Grifalconi |
| 1,718,117 | A | 6/1929 | Dainos |
| 1,839,557 | A | 1/1932 | Hilwig |
| 1,931,718 | A | 12/1933 | Chormann |
| 2,103,320 | A | 12/1937 | Corff |
| 2,187,271 | A | 1/1940 | Knapp |
| 2,231,453 | A | 2/1941 | Pitar et al. |
| 2,446,183 | A | 8/1948 | Larson |
| 2,797,536 | A | 7/1957 | Sheshler |
| 2,954,649 | A | 10/1960 | Carroll et al. |
| 3,089,294 | A | 5/1963 | Cowley |

(Continued)

FOREIGN PATENT DOCUMENTS

| | | |
|---|---|---|
| DE | 4216304 | 11/1993 |
| FR | 2620367 | 3/1988 |

(Continued)

OTHER PUBLICATIONS

PCT/US2009/049357 International Search Report; Date of Mailing: Jan. 26, 2010.

*Primary Examiner* — Eileen P. Morgan
(74) *Attorney, Agent, or Firm* — David B. Patchett

(57) ABSTRACT

The disclosure is directed to conversion assemblages adapted for use in converting a surface modifying apparatus, such as a pole sander, whereby the conversion assemblage includes a generally rigid body assembly including first and second major surfaces opposing each other, the first major surface is adapted for receiving the supporting member, and the second major surface is attachable to a surface modifying member.

19 Claims, 9 Drawing Sheets

U.S. PATENT DOCUMENTS

| | | | | | |
|---|---|---|---|---|---|
| 3,123,946 | A | | 3/1964 | Hoveland | |
| 3,183,635 | A | | 5/1965 | Spirounis | |
| 3,184,894 | A | | 5/1965 | Bayes | |
| 3,330,077 | A | | 7/1967 | Kanbar et al. | |
| 3,409,926 | A | | 11/1968 | Martin | |
| 3,703,739 | A | | 11/1972 | Young et al. | |
| 3,849,941 | A | | 11/1974 | Barnes | |
| 3,861,993 | A | | 1/1975 | Guthrie | |
| 3,964,213 | A | | 6/1976 | Tobey | |
| 4,023,312 | A | | 5/1977 | Stickney | |
| 4,202,138 | A | | 5/1980 | Smith | |
| 4,202,139 | A | | 5/1980 | Hung et al. | |
| 4,263,677 | A | | 4/1981 | Menser | |
| 4,263,755 | A | | 4/1981 | Globus | |
| 4,279,103 | A | | 7/1981 | Rodarte | |
| 4,525,959 | A | | 7/1985 | Ziebarth et al. | |
| 4,663,796 | A | | 5/1987 | Helling et al. | |
| 4,825,597 | A | * | 5/1989 | Matechuk | 451/524 |
| 4,885,876 | A | * | 12/1989 | Henke | 451/503 |
| 4,887,396 | A | | 12/1989 | Lukianoff | |
| 4,930,267 | A | | 6/1990 | Hill et al. | |
| D311,318 | S | | 10/1990 | Ovens | |
| 4,974,369 | A | | 12/1990 | Dixon | |
| D314,032 | S | | 1/1991 | Gordon | |
| 5,007,483 | A | | 4/1991 | McGuire | |
| 5,176,155 | A | | 1/1993 | Rudolph, Jr. | |
| 5,201,149 | A | | 4/1993 | Eisenblatter | |
| 5,214,820 | A | | 6/1993 | Shumway et al. | |
| 5,217,820 | A | | 6/1993 | Isshiki et al. | |
| 5,220,752 | A | * | 6/1993 | Cheney et al. | 451/344 |
| 5,222,331 | A | * | 6/1993 | Manor et al. | 451/524 |
| D346,944 | S | | 5/1994 | Poole | |
| 5,309,681 | A | * | 5/1994 | Cheney et al. | 451/344 |
| 5,323,507 | A | | 6/1994 | Tosato | |
| 5,337,523 | A | | 8/1994 | Walsh | |
| 5,382,189 | A | | 1/1995 | Arendall | |
| 5,402,559 | A | | 4/1995 | Allison et al. | |
| D358,751 | S | | 5/1995 | Kemp et al. | |
| D369,080 | S | | 4/1996 | Tollis | |
| D369,411 | S | | 4/1996 | Holt | |
| 5,533,926 | A | | 7/1996 | Nemazi | |
| 5,540,616 | A | | 7/1996 | Thayer | |
| 5,605,500 | A | * | 2/1997 | Matechuk | 451/456 |
| 5,637,034 | A | | 6/1997 | Everts et al. | |
| 5,681,213 | A | | 10/1997 | Hashii | |
| 5,692,950 | A | | 12/1997 | Rutherford et al. | |
| 5,718,622 | A | | 2/1998 | Jones | |
| 5,868,806 | A | | 2/1999 | Nishio et al. | |
| 5,895,316 | A | | 4/1999 | Williams | |
| 5,944,586 | A | * | 8/1999 | Sevigny et al. | 451/57 |
| 5,962,120 | A | | 10/1999 | Keipert | |
| 6,099,397 | A | | 8/2000 | Wurst | |
| 6,102,278 | A | | 8/2000 | Rothas | |
| 6,165,060 | A | | 12/2000 | Martin et al. | |
| 6,227,959 | B1 | | 5/2001 | Beaudry | |
| 6,244,943 | B1 | | 6/2001 | Buhler et al. | |
| 6,267,658 | B1 | | 7/2001 | Ali et al. | |
| 6,277,012 | B1 | | 8/2001 | Halliley | |
| 6,349,988 | B1 | | 4/2002 | Bitz | |
| 6,368,201 | B1 | | 4/2002 | Bitz | |
| 6,394,887 | B1 | * | 5/2002 | Edinger | 451/494 |
| 6,439,988 | B1 | | 8/2002 | Long et al. | |
| 6,524,175 | B2 | * | 2/2003 | Beaudry et al. | 451/524 |
| D474,389 | S | | 5/2003 | Panfili et al. | |
| 6,626,747 | B1 | | 9/2003 | Sidebottom | |
| D482,202 | S | | 11/2003 | Newman et al. | |
| 6,651,644 | B1 | | 11/2003 | Zuzelo | |
| 6,688,958 | B1 | | 2/2004 | Jones et al. | |
| 6,699,112 | B2 | | 3/2004 | Bergner et al. | |
| 6,712,680 | B2 | | 3/2004 | Pellegrin | |
| 6,719,320 | B2 | | 4/2004 | Gray et al. | |
| 6,746,311 | B1 | | 6/2004 | Kessel | |
| 6,780,087 | B2 | | 8/2004 | Minegar | |
| D497,092 | S | | 10/2004 | McCarthy | |
| 6,857,159 | B1 | | 2/2005 | Strine | |
| 6,896,606 | B1 | | 5/2005 | Turgeon et al. | |
| 6,923,840 | B2 | | 8/2005 | Schutz et al. | |
| 6,929,539 | B2 | | 8/2005 | Schutz et al. | |
| 6,957,934 | B2 | | 10/2005 | Masterson et al. | |
| D512,295 | S | | 12/2005 | Florio | |
| 6,991,529 | B2 | | 1/2006 | Annis et al. | |
| 7,011,573 | B2 | | 3/2006 | McArthur et al. | |
| D527,974 | S | | 9/2006 | Petersen et al. | |
| 7,131,902 | B2 | | 11/2006 | Hope | |
| 7,179,152 | B1 | | 2/2007 | Rhoades | |
| 7,186,174 | B1 | | 3/2007 | Arnold | |
| 7,396,276 | B2 | * | 7/2008 | Ali et al. | 451/356 |
| 7,497,765 | B2 | * | 3/2009 | Field et al. | 451/344 |
| 7,731,573 | B2 | | 6/2010 | Rivard et al. | |
| 7,867,064 | B2 | * | 1/2011 | Field et al. | 451/344 |
| 8,157,622 | B2 | * | 4/2012 | Ali et al. | 451/344 |
| 2001/0000503 | A1 | * | 4/2001 | Beaudry et al. | 451/523 |
| 2002/0106980 | A1 | * | 8/2002 | Bruxvoort | 451/59 |
| 2003/0148708 | A1 | | 8/2003 | Mayerhauser et al. | |
| 2004/0043715 | A1 | * | 3/2004 | Miles | 451/526 |
| 2004/0123411 | A1 | | 7/2004 | Chan | |
| 2004/0166788 | A1 | | 8/2004 | Travis | |
| 2005/0227599 | A1 | | 10/2005 | Fisher | |
| 2005/0227600 | A1 | | 10/2005 | Fisher | |
| 2005/0262773 | A1 | | 12/2005 | Schutz et al. | |
| 2007/0066186 | A1 | | 3/2007 | Annen et al. | |
| 2007/0099551 | A1 | | 5/2007 | Walsh | |
| 2007/0135029 | A1 | * | 6/2007 | Field et al. | 451/344 |
| 2009/0258585 | A1 | | 10/2009 | Miekka et al. | |

FOREIGN PATENT DOCUMENTS

| | | | |
|---|---|---|---|
| JP | 62054676 | | 3/1987 |
| JP | 2100846 | | 1/1988 |
| JP | 08-131388 | A | 5/1996 |
| JP | 3051085 | U9 | 5/1998 |
| JP | 2001-149292 | A | 6/2001 |
| JP | 3140399 | U9 | 3/2008 |

* cited by examiner

CONVERSION ASSEMBLAGE ADAPTABLE FOR USE IN COMBINATION WITH A SURFACE MODIFYING APPARATUS AND METHOD THEREOF

CROSS-REFERENCE TO RELATED APPLICATIONS

The present application is a continuation-in-part of copending and commonly assigned U.S. patent application entitled "Conversion Assemblage Adaptable For Use In Combination With A Surface Modifying Apparatus And Method Thereof" filed in the United States Patent and Trademark Office on Oct. 27, 2008, and having U.S. Ser. No. 12/258,901; and copending and commonly assigned U.S. patent application entitled "Conversion Assemblage Adaptable For Use In Combination With A Surface Modifying Apparatus And Method Thereof" filed in the United States Patent and Trademark Office on Jul. 10, 2008, and having U.S. Ser. No. 12/170,949 which are incorporated herein and made a part hereof.

BACKGROUND

The present description is directed to providing a surface modifying assemblage for use in combination with a surface modifying apparatus. More particularly, the present description is directed to providing a surface modifying assemblage and method that facilitates converting a surface modifying apparatus, such as a pole sander, with anyone of several different surface treating assemblages in an easy and reliable manner. Surface modifying devices, such as hand held tools, have been used for working or modifying a wide variety of surfaces. For example, when fabricating a structure, such as a wall or ceiling, it is sometimes necessary to utilize a sanding device to smooth the surface of the structure. For example, interior walls of office buildings and houses typically use drywall panels. The drywall panels may be attached to wood or metal frames to form interior walls and ceilings. Joints or seams are formed along edges where the different dry wall panels are juxtaposed to each other. Typically, the seams are covered with a compound and smoothed. This is to give the appearance that the seams do not exist and provide a wall that is otherwise seamless, smooth, and flat and for increased fire protection. Screw or nail holes are also filled with compound and sanded smooth. In some remodeling, the entire wall is coated to smooth the surface (often referred to as skim coating) and sanded.

Treating compounds are applied wet to the drywall to fill in the seams and any gaps between the drywall panels. Once dry, the compounds are typically sanded smooth. One known type of hand held tool assembly for sanding includes a pole sanding tool that comprises a generally rectangular sanding attachment head attached to a handle or pole through a pivoting structure. Pole sander attachment heads have a fixed size. An elongate sheet of sanding paper for treating the surface is attached to the fixed sized attachment head and usually some effort is required to properly secure the sanding paper to the attachment head due to attaching mechanisms of the latter. Usually the sanding paper is changed due to wear or tearing of paper. Accordingly, repeated efforts are required to replace these sanding papers during a typical drywall finishing operation. Sometimes replacement may take place because different sanding grades may be used.

Moreover, sanding steps generally are repeated several times until seams and gaps appear unnoticeable. The requirements for a smooth and flat finish are quite demanding. Even minor blemishes are usually found to be unacceptable. As such, repetitions of sanding tend to add to user fatigue as well as material and labor costs. Accordingly, the process is labor intensive and time consuming. As a consequence, there is an interest in making the sanding operations more efficient from a labor and time standpoint and less fatiguing in practice.

Moreover, some pole sanding tools when manipulated have a tendency for their attachment head to flip onto its elongate side and thereby gouge or otherwise damage the surface being treated. Clearly, the damage caused by flipping of pole sanders requires additional expenditures of time and labor.

In addition, some drywall finishing operations may require other surface modifying applications besides sanding, such as, cleaning, painting, and the like. Accordingly, costs for treating drywall increases due to different specialty tools and surface modifying assemblages being required before a wall may be wallpapered or painted. As a consequence, there is an interest in making such operations less expensive and time consuming. As such, there is continuing interest in seeking improvements in addressing the foregoing issues in an expeditious and cost effective manner.

SUMMARY

The present description is directed to a conversion assemblage for use in converting a surface modifying mechanism having an attaching member. The conversion assemblage comprises: a substantially rigid body assembly including first and second major surfaces opposing each other, the first major surface is attachable to a supporting member of a surface modifying mechanism; the second surface is attachable to a surface modifying member.

The present description is directed to a conversion assemblage for converting a pole sander apparatus having a pivotally connected supporting member. The assemblage comprises: a substantially rigid body assembly including first and second major surfaces opposing each other, the first major surface is adapted for receiving the supporting member, and the second major surface is attachable to a surface modifying member.

The present description is directed to a method of converting a surface modifying mechanism having an attaching member. The method comprises: providing a conversion assemblage including a body assembly made of a relatively stiff material configured with at least a first major surface and a second major surface opposing the first major surface; an attaching layer connected to the second major surface; and a surface modifying layer releasably connected to the attaching layer; and securing the surface treating assemblage to the attaching member.

The present description is directed to a conversion assemblage adapted for converting an abrading apparatus having a supporting member. The conversion assemblage comprises: a generally rigid body assembly including first and second major surfaces opposing each other, the first major surface is adapted for receiving the supporting member, and the second major surface is attachable to a surface modifying member.

The present description is directed to a conversion assemblage adapted for use in converting a surface modifying mechanism having an attaching member. The conversion assemblage comprises a generally semi-rigid rigid body assembly including first and second major surfaces opposing each other, the first major surface is attachable to a supporting member of a surface modifying mechanism; the second major surface is attachable to a surface modifying member.

The present description is directed to a conversion assemblage adapted for converting an abrading apparatus having a supporting member. The conversion assemblage comprises a generally rigid body assembly including first and second major surfaces opposing each other, the first major surface is adapted for receiving the supporting member, and the second major surface is attachable to a surface modifying member; wherein the generally rigid body assembly includes a molded member made of a relatively lightweight material; a force absorbing member attached to the second major surface; and a first attachment assemblage attached to the force absorbing member along a first major surface thereof, and the first attachment assemblage having a second major surface attachable to a surface modifying member; wherein the first attachment assemblage has longitudinal end portions secured to corresponding longitudinal end portions of the generally rigid body assembly so as to resist separation of the force absorbing member during removal of a surface modifying member.

The present description is directed to a conversion assemblage adapted for use in converting a assemblage adapted for converting an abrading apparatus having a supporting member, the conversion assemblage comprising: a generally rigid body assembly including first and second major surfaces opposing each other, the first major surface is adapted for receiving the supporting member, and the second major surface is attachable to a surface modifying member, wherein the generally rigid body assembly includes a molded member made of a relatively lightweight material, wherein a force absorbing member is molded in the second major surface of the rigid body assembly.

The present description is directed to a conversion assemblage adapted for use in converting a assemblage adapted for converting an abrading apparatus having a supporting member, the conversion assemblage comprising: a generally rigid body assembly including first and second major surfaces opposing each other, the first major surface is adapted for receiving the supporting member, and the second major surface is attachable to a surface modifying member, further including a first attachment assemblage molded to the rigid body assembly.

One aspect of the present description is for facilitating the conversion of a surface modifying mechanism, such as a pole sander or similar hand sander, with one or more conversion assemblages that enhance versatility of the pole sander through use of several different kinds of surface modifying articles.

Another aspect of the present description is for accomplishing the above in a manner that improves surface modifying efficiency and ease of worker manipulation of the surface modifying mechanism.

Another aspect of the present description is to accomplish the above by improving the efficiency of surface modification, through the use of relatively large and lightweight surface modifying assemblies in a manner that reduces user fatigue.

Another aspect of the present description is to minimize damage to surfaces, such as gouging or otherwise marring the surface finishes, when using surface modifying tools, such as pole sanders and other similar devices.

Another aspect of the present description is to accomplish the above by minimizing flipping of a pole sander during use.

Another aspect of the present description is to accomplish the above by minimizing the tearing of surface modifying sheets, such as abrasive sanding sheets during surface treating.

Another aspect of the present description is to facilitate conversions of surface modifying devices, such as pole sanders, using conversion assemblages of the kinds noted above that include restraining devices that enable secure, reliable, and quick couplings and decouplings.

Another aspect of the present description is to enhance versatility of its cooperation to a wide variety of pole sander devices.

Another aspect of the present description is to enhance the kinds of materials that may be used.

Another aspect of the present description is to accomplish the above in a manner that is cost effective to manufacture, assemble, and use.

The aspects described herein are merely a few of the several that can be achieved by using the present description. The foregoing descriptions thereof do not suggest that the present description must only be utilized in a specific manner to attain the foregoing aspects.

DETAILED DESCRIPTION

The present description is directed to a conversion assemblage and method that facilitates converting a surface modifying apparatus or tool so as to make the latter more versatile, especially in a manner for improving surface modifying efficiency as well as minimizing damage to the surface being treated and any surface modifying article being utilized.

The words "a," "an," and "the" are used interchangeably with "at least one" to mean one or more of the elements being described. By using words of orientation, such as "top," "bottom," "overlying," "front," and "back" and the like for the location of various elements in the disclosed articles, we refer to the relative position of an element with respect to a horizontally-disposed body portion.

Figure 1:
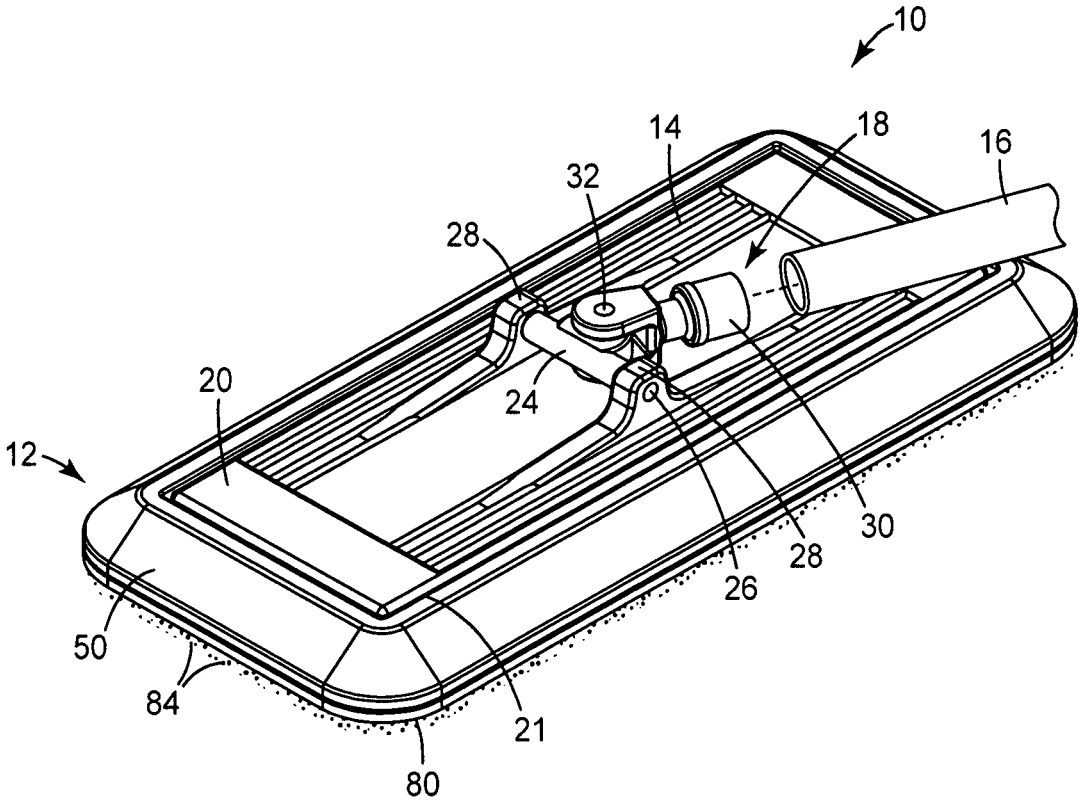
FIG. 1 is a perspective view of one exemplary embodiment of a conversion assemblage being mounted on a pole sander attachment.
Figure 2:
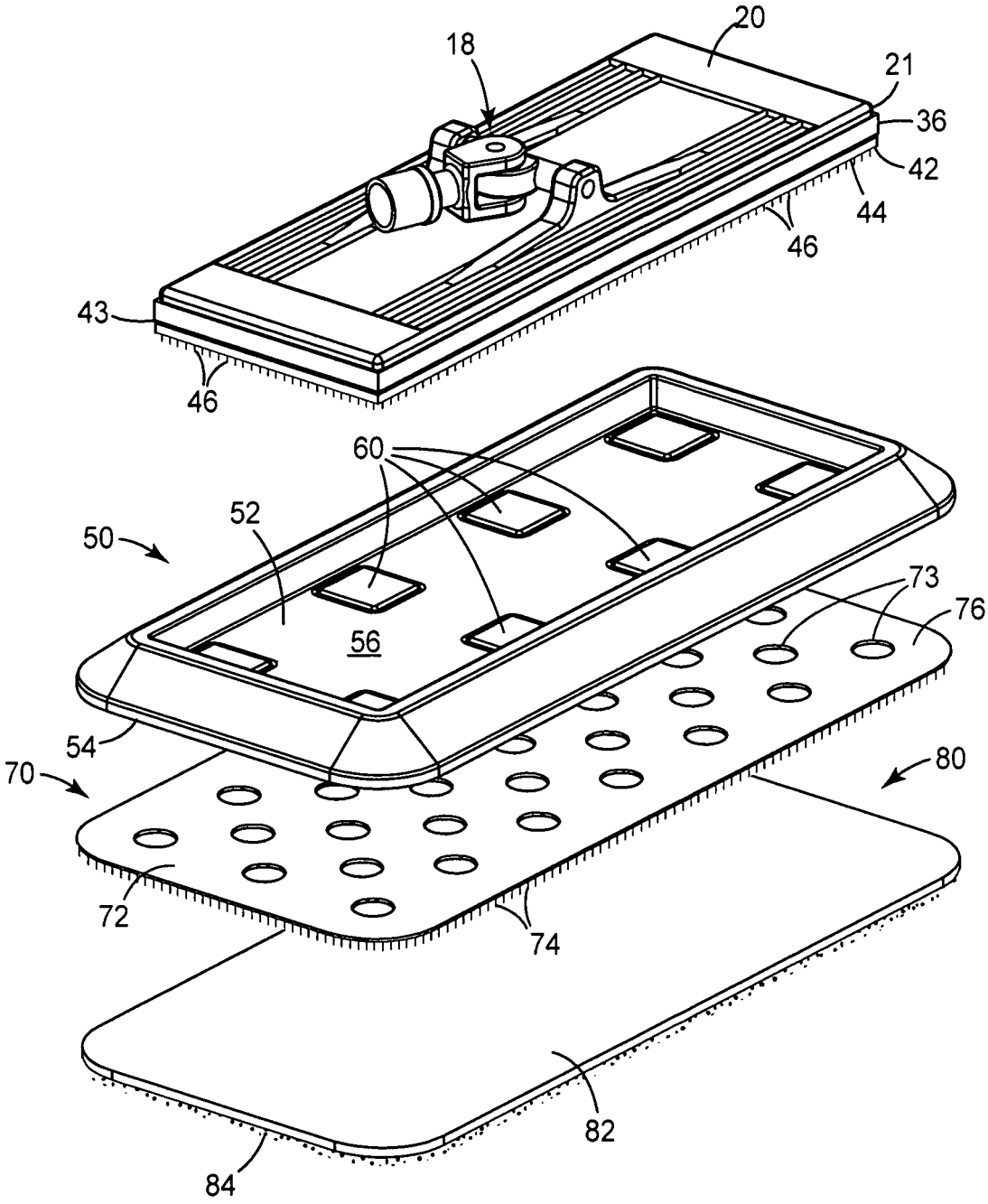
FIG. 2 is an exploded perspective view of the conversion assemblage of FIG. 1.

FIGS. 1 and 2 illustrate one exemplary embodiment of a surface modifying mechanism 10, such as a pole sanding device 10 for treating a generally planar working surface, such as a wall, ceiling or other similar structures. While one embodiment of a pole sander device is described and illustrated, it will be appreciated that other versions may be used, such as those that include wing nut and attaching clamps. Also, while a pole sanding device 10 is described, the present description envisions that a variety of hand tools may be used within the spirit and scope of the present description. In addition, while abrading a surface as by sanding is described hereinafter; the present description envisions other surface treating methods, such as cleaning, painting and the like. While a pole sanding hand tool is described as being non-motorized, it will be appreciated that the hand tool may be motorized and/or provided with additional devices, such as a vacuum device and the like.

FIGS. 1 & 2 illustrate one exemplary embodiment of a conversion assemblage 12 of present description that is adapted for converting the pole sander device 10 having a pole sander head 14, supporting member 14, or attachment member 14. In the illustrated exemplary embodiment, the conversion assemblage 12 is adapted for use in conversion of a surface modifying mechanism 10, such as a manually powered pole sander device 10. Pole sanders are typically used to reach areas, such as drywall areas, that are beyond arms reach of a user.

In FIG. 1, the pole sander head 14 or attachment member 14 is to be coupled to an extension pole 16 or handle 16, a portion of which is illustrated. Pole sander devices that may be used in the exemplary embodiments are commercially available. The extension pole 16 is to be manually operated by a user interested in treating a wall surface (not shown). The pole sander head 14 or attachment member 14 includes a pivoting or universal joint 18 mounted on a generally flat and elongated rectangular plate 20 having a bottom surface 21. The plate 20 may be made of a relatively rigid plastic or metal. The pivoting or universal joint 18 on the top surface of the plate 20, includes a sleeve 24 rotatably mounted on a pin 26 extending between two bearings 28 for rotation parallel to the longitudinal axis of the plate 20. A pole mounting fixture 30 is pivotally mounted to the sleeve 24 for rotation transverse to the longitudinal axis of the plate 20 about a pin 32. The pole mounting fixture 30 has an internal threaded fitting (not shown) for receiving an extension pole 16 in a known manner. It will be understood, however, that the scope of the present application extends to other forms of attaching a pole to the plate 20, which permit the pole to pivot longitudinally and laterally with respect to the plate 20, e.g., a ball and socket joint.

In some sanding situations, the bottom surface 21 of the pole sander head 14 may be without any material added thereto. In the illustrated embodiment, the pole sander head 14 may have a backup pad 36, such as made of Neoprene™ or a foam secured to the bottom of the plate 20. Typically, with most pole sanders an abrasive sanding paper (not shown) is added to conform to the size and shape of the backup pad 36. During usage of known sanding pole sanders, as noted above, sanding papers tend to become easily damaged, such as when striking edges or the like. In addition, the relatively small size of the backup pad and thereby the surface area being sanded tends to limit the efficiency of the sanding operation. In addition, there is very little versatility with known pole sanders since they are primarily used as sanding devices and are not generally capable of performing other surface treating applications.

According to the present description, conversion of a pole sander head 14 to accommodate the conversion assemblage 12 may commence with adding an attaching member 42. This may be done prior to adding the conversion assemblage 12 to the pole sander device 10. The attaching member 42 may be shaped and sized to generally match the size and shape of the pole sander head 14. The attaching member 42 may be provided with opposing first and second major surfaces 43, 44, respectively. The major surface 43 may be attached to the bottom surface 21 permanently as by an adhesive. Alternatively, the major surface 43 may be releasably attached to the bottom surface 21 by a pressure sensitive adhesive. While not illustrated, the present description envisions that the surfaces 21 and 43 may be joined by a releasable mechanical fastening device. In this exemplary embodiment, the attaching member 42 may be at least one strip that encompasses the surface area of the backup pad 36. The major surface 44 may include one or more strips of a hook and loop system element 46, such as hook members 46.

The conversion assemblage 12 in the illustrated exemplary embodiment is defined as a relatively rigid and lightweight body assembly 50. The body assembly 50 defines a first and second major surface 52, 54, respectively. It will be appreciated that the body assembly 50 may have a variety of shapes and sizes. To facilitate the sanding operation, the second major surface 54 has an area that is significantly larger than the area of the attachment head 14. In the exemplary embodiment, the body assembly 50 has a generally rectangular shape that is significantly larger than the attachment head, such as in the order of about 50% to about 150% larger. Of course, the present description is not limited to any such increases in size. A recess 56 in the body assembly 50 that, in part, defines the first major surface is sized to accommodate therein the pole sander head 14 including the attaching member 42, much in the manner that is illustrated in the drawings. The recess may be sized and shaped to receive the supporting member so that its center of gravity is close to a center of gravity of the body assembly, whereby flipping over of the body assembly during use is inhibited. Because the attachment makes the surface modifying mechanism wider, it tends to flatten the angle between the pivot point 32 and the edge of the surface modifying mechanism.

The body assembly 50 is made of a molded lightweight, low density, relatively strong, and stiff thermoplastic, thermosetting, or cast metal material. The rigidity is useful from a standpoint of enabling a user to apply pressure more uniformly to a surface modifying article being carried thereby. A rigid backing for abrasives tends to make for a flatter finish provided by the abrasives. The low density and generally lightweight construction allows the molded body assembly 50 to be relatively easily handled by a user. This tends to lower fatigue during use. In addition, the rigid and lightweight construction enables formation of relatively larger surface abrading areas without drawbacks of additional weight. Also, the low density and relatively rigid construction enables formation of a relatively stiff raised edge, compared to conventional pole sander attachment head backup pad. This is particularly useful for abrading in corners, such as between ceilings and wall surfaces. The raised edge of the attachment provides stiffness thereby keeping the surface modifying mechanism generally flat. The relatively raised edge tends to lessen the likelihood of abrasive surfaces, such as paper type abrasives articles, being torn or otherwise damaged. Also, the material of the present description is intended to be reusable, thereby enhancing overall versatility of the conversion assembly, since many different surface modifying articles may be added thereto. Accordingly, the body assembly 50 may dispense with the need for requiring different tools that carried different surface modifying articles.

In the exemplary embodiment, the present description envisions use of a molded polystyrene foam material that has a relatively low density. For example, the density may be in the order of about 2.50 pounds/ft.$^3$ to about 6.00 pounds/ft.$^3$. The molded polystyrene foam may be open or closed cell although in the exemplary embodiment it is a closed cell type. Other suitable materials may be used, such as but not limited to polymeric foams, such as, polystyrenes, polyurethanes, polyolefins, polyesters, and combinations thereof.

Referring back to the recess 56, it includes an attachment assemblage that may include a plurality of pads 60 having exposed loop type fastening elements (not shown) that are adapted to releasably and engage and attach to the hook elements on the attaching member 42. While a plurality of pads 60 are disclosed, a single pad may be used instead. In addition, the present description envisions use of other releasable attachment mechanisms including a smooth surface that could cooperate with a pressure sensitive adhesive attaching member.

Connected to the second major surface is an attachment assemblage or layer 70 for use in releasable connection to a surface modifying member 80. In the exemplary embodiment, the attachment layer 70 may be a pad 72 having openings 73 that reduce weight and have projecting hooks 74 on a bottom major surface thereof, whereas the upper major surface may have a pressure sensitive adhesive layer 76 for releasable attachment to the second major surface 54. The hooks 74 are adapted to releasably engage the surface modifying member 80. In the exemplary embodiment, the surface modifying member 80 may be a foam backed abrasive article 80. The foam backed abrasive article 80 includes a foam back attachment layer 82 that has a working surface 84 which includes abrasive particles 84 coated thereto. The foam attachment layer 82 may be made of a relatively thin and lightweight material. The abrasives may be made of any suitable material. Because of the versatility of the present description, different abrasive grades for sanding may be used, such as 100, 120 and 150. These examples are merely illustrative and are not considered limiting. In one exemplary embodiment, the foam back attachment layer 82 may be lightweight polyurethane, such as molded open cell polyurethane. In other embodiments, synthetic polymer foams, such as, polyurethanes, Neoprene™, styrenebutadiene rubber, polyethylenes, acrylic foams, and combinations thereof may be used. The thickness of the foam back attachment layer 82 may be in the order of about 1-5 mm. Other exemplary examples may include sanding pads that are commercially available from 3M Company, St. Paul, Minn. and typically have thickness of about 5 mm (or 0.127 inches or 127 mils). Another example includes an abrasive foam backup of about 2-3 mm or 50 to 75 mils up to the about 5 mm. Backup pads on pole sander may have a thickness in a range of about ⅛ inch to about ¼ inch. It will be appreciated that if the foam back attachment layer 82 extends beyond the edges of the body assembly 50, there will be less of a likelihood of damage (e.g., grooves) occurring to a wall at a corner that is engaged by the surface modifying apparatus because of initial engagement by the relatively soft foam against such a wall. Similarly, if one or more edges of the body assembly 50 is offset relative to the foam back attachment layer or sanding paper layer, the body assembly will not cause damage to a wall at a corner wall.

In another one exemplary embodiment, such a foam backed abrasive article may be commercially available from 3M Company, St. Paul, Minn. under the trade name Sandblaster™. While foam backed abrasive article may be used, other coupling mechanisms for coupling a surface modifying abrasive mechanisms may be used. For example, the present description envisions all kinds of releasable attachment mechanisms, including, but not limited, to a wide variety of hook and loop fastening elements or mechanisms or the like. Some fastening elements include solid protrusions including a stem and an expanded region or head that may take a variety of shapes. Exemplary patents describing this latter type of a fastener include: U.S. Pat. Nos. 3,192,589 and 5,097,570. Another type of fastening element including a multiplicity of intermeshing solid protrusions is described in U.S. Pat. No. 4,875,259. An example of a suitable hook and loop mechanism is commercially available from 3M Company, St. Paul, Minn. under the trade name designations Hookit™ and Hookit™ II. Other suitable configurations of hook and loop attachments are within the scope of the present disclosure. Also, any suitable adhesive system including any kind of pressure-sensitive adhesive may be used instead of the hook and loop arrangements.

Figure 3:
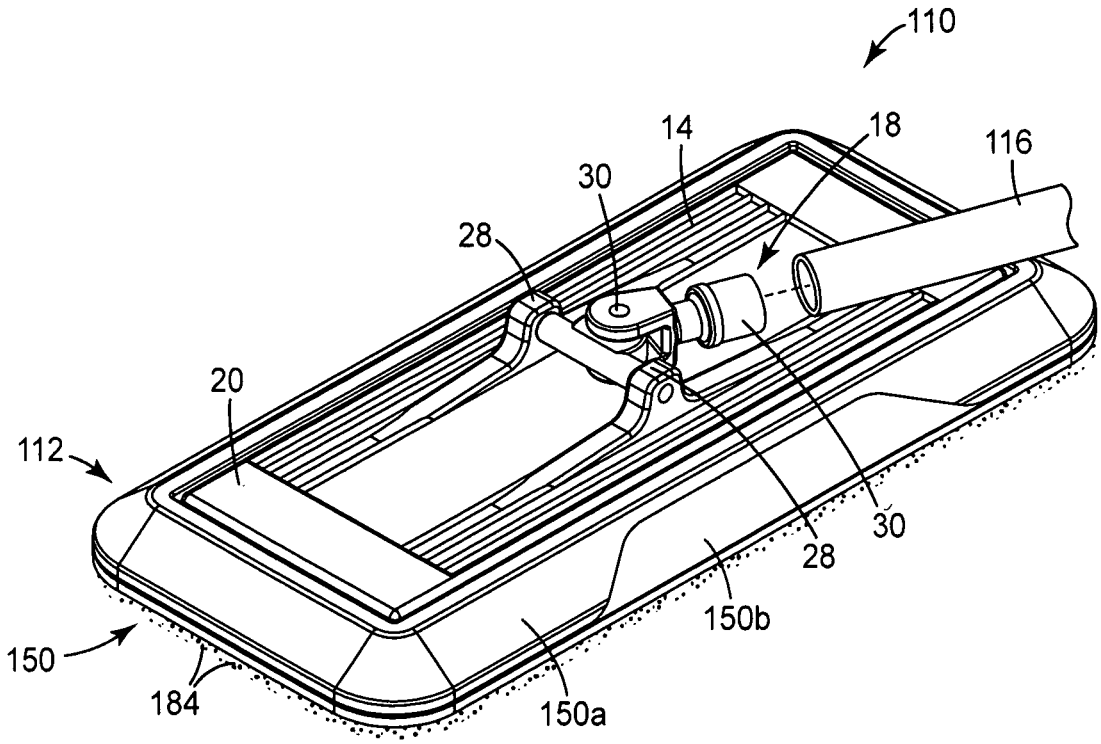
FIG. 3 is a perspective view of another exemplary embodiment of a conversion assemblage being mounted on a pole sander attachment.
Figure 4:
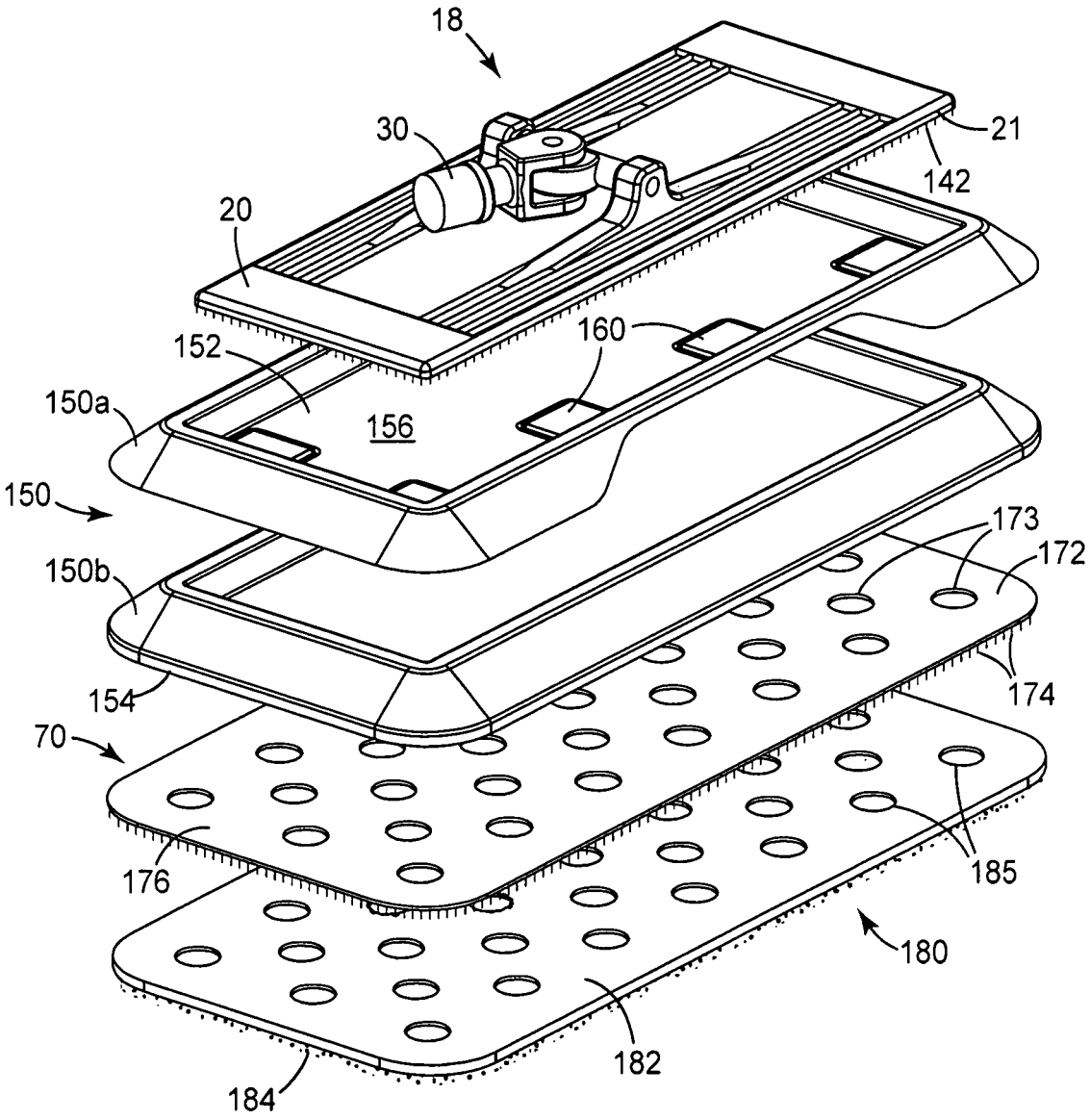
FIG. 4 is an exploded perspective view of the conversion assemblage of FIG. 3.

Reference is now made to FIGS. 3 & 4 for illustrating another exemplary embodiment of the present description which is similar to FIGS. 1 & 2. Accordingly, similar structure is represented by similar reference numerals with the addition, however of the prefix "1". Differences of this embodiment to the foregoing include the body assembly 150 may be a two-piece upper and lower 150*a* and 150*b*, respectively, construction made of suitable plastic, such as expanded polystyrene, polyethylene, ABS, and Neoprene™, and combination thereof. In addition, the foam backed surface modifying article 180 may be provided with openings 185 therein for reducing weight of the overall conversion assemblage.

Figure 5:
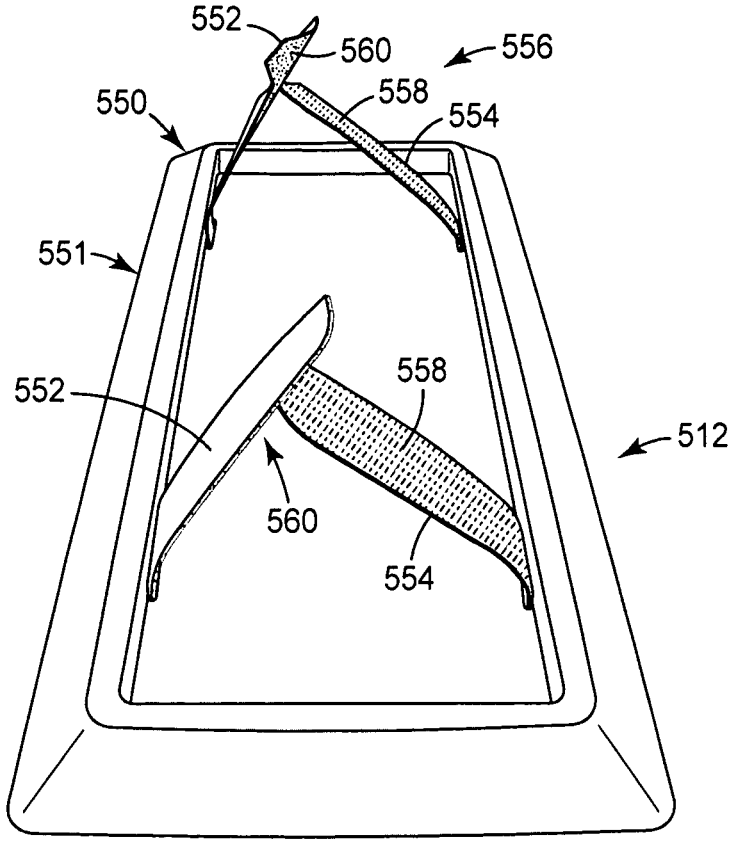
FIG. 5 is a perspective view of another exemplary embodiment of a conversion assemblage having an improved restraining arrangement.

FIG. 5 is a perspective view of another exemplary embodiment of a conversion assemblage 512 including a body assembly 550 having a first attachment assemblage 551 or restraining assembly 551 for use in easily, releasably, and securely holding the surface modifying tool (not shown), such as a pole sander of the type depicted in FIG. 1. The body assembly 550 is made of a molded lightweight, low density, relatively strong, and stiff thermoplastic material of the kinds noted above. The rigidity is useful from a standpoint of enabling a user to apply pressure more uniformly to a surface modifying article being carried thereby. A rigid backing for abrasives tends to make for a flatter finish provided by the abrasives. The low density and generally lightweight construction allows the molded body assembly 550 to be relatively easily handled by a user. In the illustrated embodiment, the restraining assembly 551 may include one or more pairs of flexible restraining straps 552 and 554. In the illustrated embodiment, two pairs of restraining straps 552 and 554 are depicted for purposes of illustration. Each pair of straps may be secured together by a releasable securing mechanism 556. The straps 552 and 554 may be comprised of elongated and generally flexible bodies having generally planar opposing sides. The straps 552 and 554 are in a recess for receiving the attachment head of the pole sander. In the illustrated embodiment, the releasable securing mechanism 556 may include a hook-and-loop fastener arrangement for providing a releasable fastener arrangement. In this regard, the end portions of the restraining straps 552 and 554 may have corresponding and mating hook 558 and loop 560 portions that selectively couple and decouple them together. It will be appreciated that the restraining assembly 551, as arranged, is adapted to fit over the attachment head (not shown) of the pole sander (not shown) to secure it to the conversion assemblage 512. As such, the restraining assembly 551 is intended to allow a quick connect and disconnect of the pole sander from the conversion assemblage of the present description, but at the same time restrain the two together to prevent relative movement during surface modification procedures. The restraining straps 552 and 554 may be made of any suitable materials, such as cloth plastic, leather, and combinations thereof. While a hook-and-loop releasable fastener arrangement is illustrated as a releasable securing mechanism 556, the present description envisions that any other suitable approaches may be used. These other approaches include, but are not limited to, buckle arrangements, sliding engaging fasteners, locking pawls, latches, snap-fitting devices, pressure sensitive adhesive tapes, magnetic devices, slidable or pivoting members on the conversion assemblage that slide or pivot over the attachment head to restrain the latter to the former. Also, the present description envisions that the restraining assembly may be made of any of a wide variety of structures and materials to achieve a secure coupling of the conversion assemblage and the surface modifying apparatus. The restraining assembly 551 may include, but not be limited to, the following materials including, but not limited to cloth, plastic, leather, and suitable materials as well as combinations thereof. Also, the restraining assembly may include, but are not limited to, buckle arrangements, sliding engaging fasteners, locking pawls, latches, snap-fitting devices, pressure sensitive adhesive tapes, magnetic devices, slidable or pivoting members on the conversion assemblage that slide or pivot over the attachment head to restrain the latter to the former.

Figure 6:
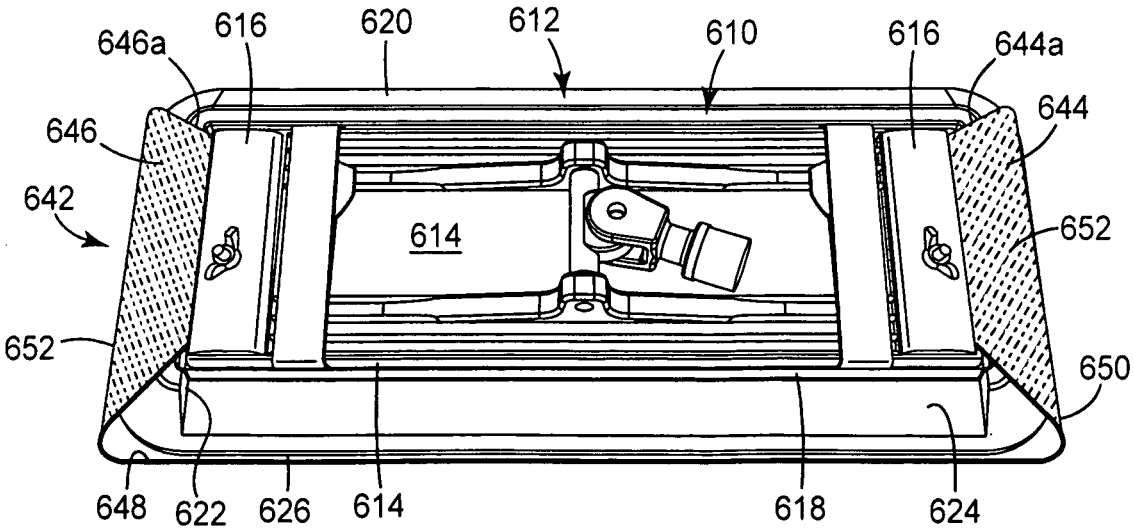
FIG. 6 is a perspective view of yet another exemplary embodiment of a conversion assemblage having an improved restraining arrangement.

FIG. 6 illustrates yet another exemplary embodiment of the present description. In this exemplary embodiment, a surface modifying tool 610, such as a known type of pole sander 610 is adapted to be used in combination with a conversion assemblage 612. In this exemplary embodiment, the pole sander 610 includes an attachment head 614 that may be quickly and easily coupled together with the conversion assemblage 612 as will be described. In this exemplary embodiment, the pole sander attachment head 614 includes a typical pair of clamps 616 at opposite ends thereof that are threadedly secured thereto as by wing nuts or the like so as to be appropriately raised and lowered for securing purposes as will be described. Typically, such clamps, as noted above, act to secure ends of abrasive sheets to the attachment head. The attachment head 614 typically includes a resilient element 618 made of Neoprene™ or other suitable material and is disposed on a bottom surface thereof.

In this exemplary embodiment, the conversion assemblage 612 provides for side loading of the pole sander attachment head 614. The conversion assemblage 612 includes a body assembly 620 similar to that described above in FIGS. 1 & 2. As such, the body assembly 620 maybe made of a molded lightweight, low density, relatively strong, and stiff thermoplastic, thermosetting or cast materials of the kinds noted above. The rigidity is useful from a standpoint of enabling a user to apply pressure more uniformly to a surface modifying article being carried thereby. A rigid backing for abrasives tends to make for a flatter finish provided by the abrasives. The low density and generally lightweight construction allows the molded body assembly 620 to be relatively easily handled by a user. However, one difference of this embodiment from the previous embodiment is provision of a lateral opening 622 that allows sliding insertion and removal of the pole sander attachment head so that it may be accommodated as by nesting in a recess 624 as illustrated. Alternatively, just a lower edge may work well to slide the tool into a shallow cavity. As in the previous embodiment, the body assembly 620 may also have a variety of shapes and sizes. To facilitate a sanding operation, a major surface 626 on the bottom has an area that is significantly larger than the area of the attachment head 614. In the exemplary embodiment, the body assembly 620 may also have a generally rectangular shape that is significantly larger than the attachment head, such as in the order of about 50% to about 150% larger. Of course, the present description is not limited to any such increases in size. The recess 624 may be sized and shaped to receive the supporting member so that its center of gravity is close to a center of gravity of the body assembly, whereby flipping over of the body assembly during use is inhibited.

Figure 7:
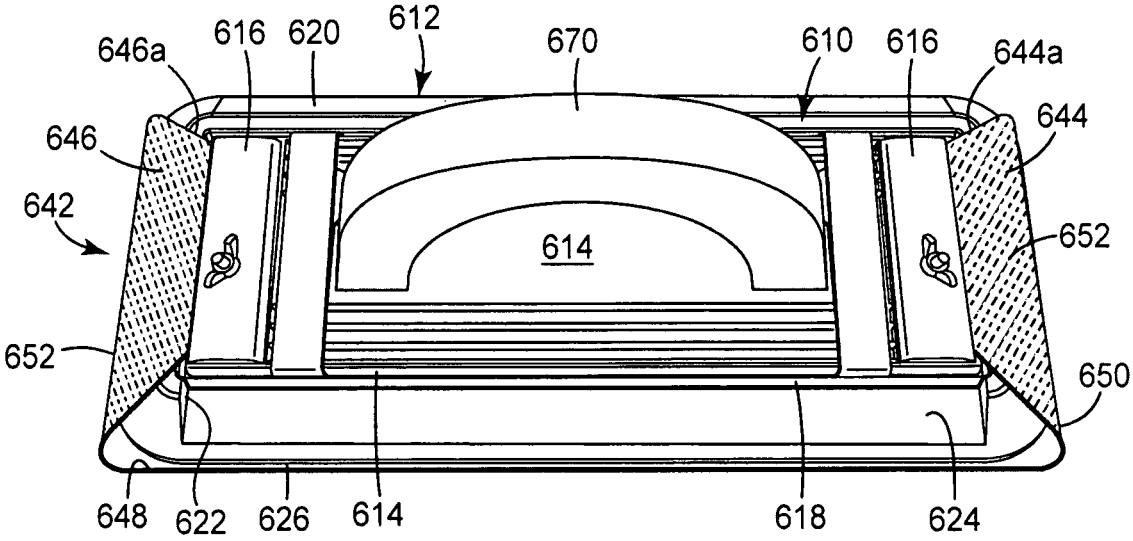
FIG. 7 is a perspective view similar to FIG. 6, but illustrating a hand sander instead of a pole sander.

In this exemplary embodiment, provision is made for a versatile attaching member 642 that may be a single member and acts to not only secure the conversions assemblage 612 to the pole sander 610, but also serves to secure a surface modifying member (not shown), such as an abrasive pad (not shown). The surface modifying member may be similar to that described in the embodiment depicted in FIGS. 1-2. In this embodiment, the attaching member 642 includes both a first attachment assemblage and a second attachment assemblage. The first attachment assemblage thereof is adapted to secure the conversion assemblage 612 to the pole sander 610 and the second attachment assemblage is adapted to secure the conversion assemblage to surface modifying member. As such, the attaching member 642 may be an elongated strip that has opposing longitudinal end portions 644 and 646 with wings 644*a*, 646*a* that form part of the first attachment mechanism and are to be clamped by the clamps 616. The attaching member 642 may be shaped and sized to generally match the size and shape of the body assembly 620. The attaching member 642 may be provided with opposing first and second major surfaces 648, 650, respectively. In the present illustrated exemplary embodiment, the first major surface 648, intermediate the end portions may form the second attachment assemblage and may be attached permanently to a bottom surface 626 of the body assembly 620 by any suitable approach that includes, but is not limited to adhesives, clamps or the like. Additionally, the attaching member 642 may be a separate part that is releasably secured to a bottom surface of the body assembly 620. Any suitable mechanism for releasably securing the attaching member 642 to the body assembly 620 is contemplated and may include, but not be limited to, pressure sensitive adhesives, mechanical hook-and-loop fastener arrangements, or the like and combinations thereof. The second major surface 650 may include one or more strip portions of a hook and loop system element 652, such as hook members 652 or alternatively loop members. The hook members 652 are adapted to engage an appropriate surface of a corresponding surface modifying article, such as of the types noted above. As in the other embodiments, the present exemplary embodiment envisions other releasable attachment mechanisms. The hook members 652 enable quick and reliable securing of a surface modifying article thereto. FIG. 7 illustrates a surface modifying mechanism similar to FIG. 6 and the same reference numerals are used to designate the same structure with, however, a handle 670 being used instead of a pole sander attachment. Also, it will be appreciated that the straps illustrated in FIGS. 6 & 7 for securing the pole or hand sander attachment need not be provided.

Figure 8:
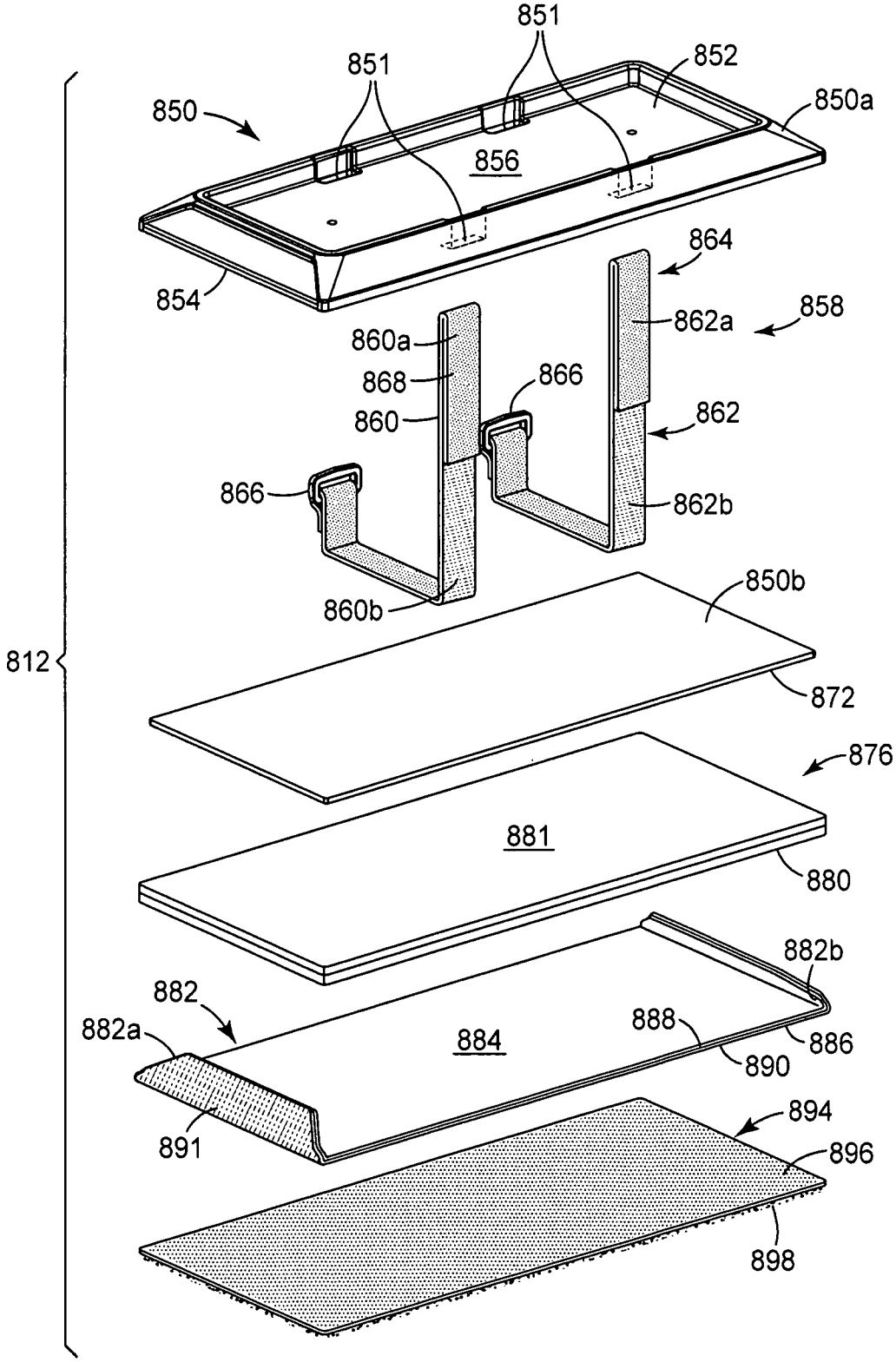
FIG. 8 an exploded perspective view of another exemplary embodiment of the conversion assemblage.
Figure 9:
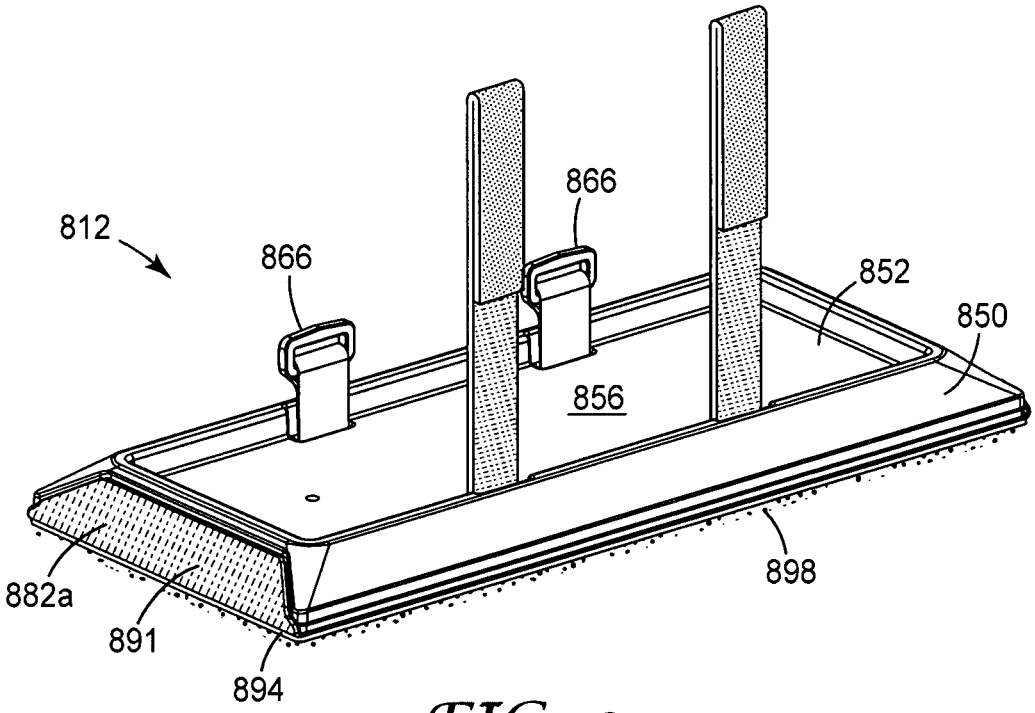
FIG. 9 is a perspective view of the assemble conversion assemblage and a surface modifying article.

FIGS. 8 & 9 depict another exemplary embodiment of a conversion assemblage 812 consistent with the teachings of the present description. The conversion assemblage 812 may be defined as a relatively rigid and lightweight molded body assembly 850 similar to, for example, the body assemblies depicted in FIGS. 5 & 6.

As in the previous embodiments, the body assembly 850 defines a first and second major surface 852, 854, respectively. The molded body assembly 850 may have a variety of shapes and sizes. The body assembly 850 may have a generally rectangular shape that is significantly larger than the generally rectangular shape attachment head of a pole sander. To facilitate sanding operations, for example, the second major surface 854 also has an area that may be significantly larger than the area of the attachment head (not shown) of a pole sander. The increase in size may be in the order of about 50% to about 150% larger. Of course, the present embodiment is not limited to any such increases in size.

A recess 856 in the body assembly 850 that, in part, defines the first major surface 852 is sized to accommodate therein the pole sander head (not shown) including any attaching member. The pole sander head may be of the type similar to those illustrated and described herein. Because the conversion assemblage 812 makes the surface modifying mechanism wider, it tends to flatten the angle between a pivot point of the tool and the edge of a surface modifying mechanism 894. The body assembly 850 may be comprised of top portion 850*a* and a mating bottom portion 850*b*. The bottom portion 850*b* may have a generally flat major surface. The body assembly 850 may made of the materials noted above in regard to the other exemplary embodiments. As such, the body assembly 850 maybe made of a molded lightweight, low density, relatively strong and stiff thermoplastic, thermosetting or cast materials. In the present exemplary embodiment, a relatively high impact polystyrene material, such as molded acrylonitrile butadiene styrene (ABS) material may be used. ABS is lightweight, has a relatively low density provides stiffness consistent with the teachings of the present description, as well as provides for shock absorbance of the type occasioned by a user impacting a walled surface during use. The ABS body assembly 850 may have density in the range of about 0.35 lb/in$^3$ to 0.65 lb/in$^3$ More typically, the density may range from 0.40 lb/in$^3$ to 0.60 lb/in$^3$. In one embodiment, the body assembly 850 may be injection molded, but other molding processes are envisioned as well, such as thermoforming, milling, and casting. The injection molded ABS body assembly 850 may have a flexural modulus may range from 30,000 lb/in$^2$ to 40,000 lb/in$^2$. Readings that are more typical may range from about 32,500 lb/in$^2$ to about 37,500 lb/in$^2$. Other suitable materials may be used, such as but not limited to polymeric foams, such as, polystyrenes, polyurethanes, polyolefins, polyesters, and combinations thereof It will be appreciated that these other suitable materials will have a flexural modulus similar to the above values.

Opposing pairs of openings 851 are formed in the recess 856, as illustrated in FIG. 8, for cooperation with a first attachment assemblage 858 or restraining assembly 858. The restraining assembly 858 is particularly adapted to easily, releasably, and securely hold a surface modifying tool (not shown), such as a pole sander much as is illustrated in FIG. 5. In the illustrated embodiment, two restraining straps 860 and 862 are depicted for purposes of illustration. The restraining straps 860 and 862 are adapted to fit with their respective pair of openings 851. Each of the restraining straps 860 and 862 may be secured together by a releasable securing mechanism 864. The releasable securing mechanism 864 in the illustrated exemplary embodiment may include a releasable mechanical connection, such as a hook and loop type. The restraining straps 860 and 862 have opposing planar major surfaces. One side of each of the restraining straps 860 and 862 may have hooking type material 860*a*, 862*a* thereon and the other side may have looping type material 860*b*, 862*b*. Instead of the straps passing through the openings 851, they may be overmolded to the body assembly 850 be integral therewith.

End portions of each strap may have a plastic loop member 866 attached thereto through the opposite free end portion may pass. The free end portion of the restraining straps 860 and 862 may have a folded over hook portion 868 so that it passes through the loop member 866 and is adapted to engage the type material 860*b*, 862*b* extending on an opposite side of each strap. The folded over hook portion 868 after passing through the loop member 866 may be pulled to cinch the restraining straps 860 and 862 over a pole sander attachment head to secure it the conversion assemblage 812. This provides a simple manner of releasably securing the conversion assemblage 812 to the pole sander. After the restraining straps 860 and 862 have been attached, the mating bottom portion 850*b* may be secured to the top portion 850*a*. The bottom portion 850*b* may be secured, as by ultrasonic welding, adhesives, or other similar approaches. The bottom portion 850*b* may be provided with a generally flat major surface 872.

It will be appreciated that the restraining straps 860 and 862 may also be made of any suitable materials, such as cloth, plastic, leather, and combinations thereof. While a hook-and-loop releasable fastener arrangement is illustrated for the releasable securing mechanism 864, the present description envisions that any other suitable approaches. Other approaches include, but are not limited to, buckle arrangements, sliding engaging fasteners, locking pawls, latches, snap-fitting devices, pressure sensitive adhesive tapes, magnetic devices, slidable or pivoting members on the conversion assemblage that slide or pivot over the attachment head to restrain the latter to the former. The restraining assembly 858 may include, but not be limited to, buckle arrangements, sliding engaging fasteners, locking pawls, latches, snap-fitting devices, pressure sensitive adhesive tapes, magnetic devices, slidable or pivoting members on the conversion assemblage that slide or pivot over the attachment head to restrain the latter to the former.

The present embodiment envisions the use of a force absorbing adapter assembly 876 that may include a force absorbing back-up pad 880, layer 880 or element 880 for providing a cushioning effect as the surface modifying article, such as an abrasive article abrades a surface. Cushioning is effective in many situations wherein the surface to be treated is hard. In the present exemplary embodiment, the force absorbing layer may be a generally rectangular back-up pad 880 that is sized and shaped to be secured to match the major surface 872 of the bottom housing portion 851*b* for supporting the abrasive article. The back-up pad 880 provides some cushioning or resiliency to minimize tearing of an abrasive pad during surface modification. An adhesive layer 881 may be applied to a top major surface of the back-up pad 880 to act as an interface with the molded housing assembly 850. The adhesive layer 881 may be a suitable type, such as styrene butadiene rubber (SBR) that is applied to the major surface 872 or similar adhesive materials including rubber-based adhesives, acrylics, silicones, permanent type pressure adhesive materials and combinations thereof that are commercially available may be used.

The back-up pad 880 may made from several materials, such as, but not limited to lightweight polyurethane, such as molded open or close cell polyurethane, synthetic polymer foams, such as polyurethanes, Neoprene™, styrene butadiene rubber, polyethylene, acrylic foams, and combinations thereof. The back-up pad 880 may have a thickness, such as about 1 mm to about 5 mm. More typically, the thickness may range from about 2 mm to about 4 mm. Alternatively, the thickness may range from about 1/16 inch (e.g., 62.5 mils) to about 1/4 (e.g., 250 mils) inch. Thicknesses in these ranges provide advantages of minimizing flipping while providing cushioning and to soften the scratch to the abrasive. In the exemplary embodiment, the back-up pad 880 may have a density of about 2 lb/ft$^3$ to about 5 lb/ft$^3$. More typical density ranges may be from about 2 lb/ft$^3$ to about 3 lb/ft$^3$. The back-up pad may have a Shore A hardness at 72 degrees F. that is in a range of about 30 A to about 60 A, and, more typically, in a range of from about 30 A to 50 A, and even more typically in a range of from about 25 A to 50 A. As such, this serves to not concentrate the sanding force in one spot and yet apply more pressure to the high areas needing to be reduced. The material of the back-up pad should be relatively stiff to retain its shape if set down.

In this exemplary embodiment, the provision is made for an attaching member 882 or assemblage 882 for attaching the conversion assemblage 812 to the surface modifying member 894. The attaching member 882 may be an integral member that is secured to the back-up pad 880 642 (FIG. 6). The attaching member 882 is connected directly to the back-up pad 880 and may have opposing longitudinal end portions 882*a*, 882*b* for securing to corresponding end portions of the body assembly 850. The longitudinal end portions 882*a*, 882*b* are unlike the attaching member 642 insofar as they are not to be secured to and by a pole sander attachment. In such embodiments, the longitudinal end portions serve to wrap around the ends and this tends to minimize peeling separation of the back-up pad and associated hook or loop during removal of the abrasive sheet. Accordingly, use of the attaching member 882 is not dependent on a pole sander having any attaching or coupling mechanisms for use therewith. As such, the attaching member 882 allows the conversion assembly 812 to be used in combination with more pole sanders that are not limited to ones having clamps or members.

The attaching member 882 may be provided with opposing first and second major surfaces 884, 886, respectively. In the present illustrated exemplary embodiment, the first major surface 884 may be attached permanently to a bottom surface of the back-up pad 880 by any suitable approach that includes, but is not limited to adhesives, clamps or the like. In the present exemplary embodiment, the attaching member 882 includes an adhesive layer 888 defining the first major surface 884 and a strip of a releasable mechanical connection mechanism 890 defining the second major surface 886. The releasable mechanical connection mechanism 890 may have a hook and loop system 891 defining the second major surface 886. The hook and loop system 891 is adapted to be releasably secured to a matable and complementary portion of a hook and loop system 896 on a first major surface of the surface modifying mechanism 894, article 894.

The adhesive layer 888 may be made of one of a variety of suitable adhesives used with hook and loop systems and may include, but not be limited to, rubber-based adhesives, acrylics, silicones, and combinations thereof. In the illustrated exemplary embodiment, the adhesive layer 888 is a rubber-based adhesive that is adaptable for securing a strip of the hook and loop system 891. Many kinds of such suitable adhesives are commercially available.

As depicted in FIG. 9, the adhesive layer 888 of the attaching member 882 is secured to a bottom surface of the back-up pad 880 as well as has its longitudinal end portions 892*a*, 892*b* attached adhesively to corresponding longitudinal end portions of the body assembly 850. In the illustrated exemplary embodiment of the hook and loop system 891 a looping carrying member may be utilized. It will be understood that if the looping carrying member is utilized then the complementary surface of the surface modifying article will be a complementary hooking carrying member. In one exemplary embodiment, the releasable mechanical connection mechanism 890 may be commercially available from 3M Company, St. Paul, Minn. under the trade name designations Hookit™ and Hookit™ II. Alternatively, the loop carrying attaching member 882 may be made of a strip of warp knit loop pile, such as a nylon warp knit pile sold under the trade designation Velcro™ 3610 that is commercially available from Velcro USA, Inc. Other suitable configurations of hook and loop systems are within the scope of the present disclosure. Also, any suitable pressure-sensitive adhesive may be used instead of the hook and loop arrangements for effecting a releasable connection between the conversion assemblage 812 and the surface modifying article 894.

The surface modifying member 894 may be similar to that described in the exemplary embodiments depicted in FIGS. 1-7. It will be appreciated that surface modifying member 894 may have a releasable mechanical attachment assemblage, such as a hook and loop system 896 for use as an interface layer and opposite thereto an abrasive layer 898. The hook and loop system 896 may be constructed in a manner so that it is compatible and complementary to the component of the hook and loop system used on the attaching member 882. In this exemplary embodiment, the surface modifying member 894 is sized and shaped to be generally rectangular and match the periphery of the backup pad.

The embodiment shown in FIG. 8 can also be described as follows. Conversion assemblage 812 is adapted for converting an attachment head of a pole sander, such as pole sander head 14 shown in FIG. 1. Conversion assemblage comprises: a generally rigid body assembly comprising top portion 850*a* and bottom portion 850*b* which may be welded together as described above. The generally rigid body assembly includes first major surface 852 and opposing second major surface 872, the first major surface defining recess 856 for receiving the attachment head of the pole sander, and the second major surface being generally flat and attachable to a surface modifying member such as surface modifying member 894. As described above, generally rigid body assembly comprising top portion 850*a* and bottom portion 850*b* has an area larger than that of the attachment head. For example, generally rigid body assembly comprising top portion 850*a* and bottom portion 850*b* can have an area of about 50 to about 100% larger than that of the attachment head. Generally rigid body assembly comprising top portion 850*a* and bottom portion 850*b* may comprise opposing pairs of openings 851, each pair of openings fitted with a restraining strap such as 862 and 864 for securing the conversion assemblage to the attachment head.

Conversion assemblage 812 may further include force absorbing member 876 adhesively secured to second major surface 872. Attaching member 882 comprising first major surface 884 and second major surface 886 may also be included in the conversion assemblage. First major surface 884 may be adhesively secured to the force absorbing member by adhesive layer 888, and second major surface 886 may comprise a first releasable mechanical connection mechanism. For example, the first releasable mechanical connection mechanism may comprise a loop system of hook and loop system 891, the loop system being adapted to secure to a hook system of the surface modifying member. Attaching member 882 may comprise opposing longitudinal end portions 882*a* and 882*b*, each longitudinal end portion adapted to wrap around the ends of the force absorbing member and the generally rigid body assembly. In some embodiments, as described above, attaching member 882 is not securable to the attachment head of the pole sander. Conversion assemblage 812 may further comprise surface modifying member 894 having first major surface 896 and second major surface 898, first major surface 896 comprising a second releasable mechanical connection mechanism matable with that of the first, and second major surface 898 comprising an abrasive layer. For example, the second releasable mechanical connection mechanism may comprise a hook system of hook and loop system 891.

A pole sanding device may be made by converting a pole sander with conversion assemblage 812. The pole sanding device would be made by providing a pole sander such as the pole sander shown in FIG. 1 having attachment head 14 mounted to extension pole 16, and attaching the assemblage to the attachment head.

Figure 10:
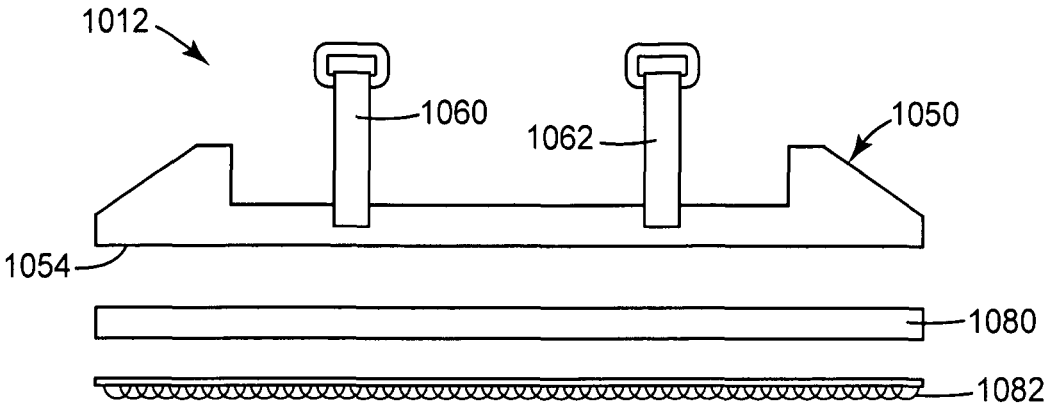
FIG. 10 is a schematic view of another exemplary embodiment of the present description.
Figure 11:
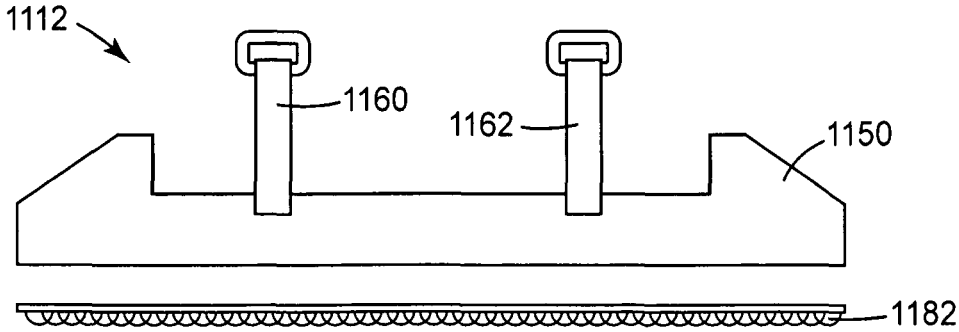
FIG. 11 is a schematic view of another exemplary embodiment of the present description.

FIG. 10 illustrates another exemplary embodiment similar to the conversion assembly 812 described in FIGS. 8 & 9. In the present exemplary embodiment of the conversion assembly 1012, the adhesive layers at the interfaces have been eliminated. The restraining straps 1060 and 1062, as noted, above may be overmolded together with the body assembly 1050. In this embodiment, the materials may be as described above for each of the components. It will be appreciated that the materials may be suitably selected to facilitate the overmolding. The materials for the body assembly 1050 and the back-up pad 1080 may similar to those described above. For example, the molded body assembly 1050 may have its flexural modulus in a range, as noted above, of from about 30,000 lb/in$^2$ to about 40,000 lb/in$^2$. The back-up pad, may, as in the other embodiments, have its durometer in a range as noted above (e.g., 30 A to 60 A). The present exemplary embodiment envisions the use of other suitable molding approaches. In this embodiment, the back-up pad 1080 is overmolded directly to the bottom major surface 1054 of the molded body assembly 1050. The attaching member 1082 may be overmolded to back-up pad 1080 In the exemplary embodiment, the attaching member 1082 may comprise a hooking or looping component of a hook and loop mechanical system of the kinds described above. In the present embodiment, the attaching member 1082 is an in-molded strip of loop material such as Hookit™ II loop material commercially available from 3M Company, St. Paul, Minn. This embodiment of the attaching member 1082 includes the looped material strip of fabric and a cloth backing (not shown) that are adhesively bonded together, such as by a transfer adhesive, hot melt rubber based, or acrylic adhesive in thin layers totaling, for example, 5 to 15 mils to provide a barrier layer for inhibiting foam material from the back-up pad 1080 from bleeding through during the overmolding. The in-molded strip of looping material may be overmolded to all or a part of the bottom major surface of the back-up pad. Of course, other releasable mechanical fasteners, such as hook and loop fasteners may be overmolded besides the Hookit™ II system described earlier. For appearance purposes as well as performance purposes, a barrier layer should be provided to prevent the foam material from bleeding into and through the in-molded strip of loop material. FIG. 11 is yet another exemplary embodiment of a conversion assembly 1112, wherein the attaching member 1182 that is similar to the attaching member 1082 is overmolded together to a body assembly 1150. The body assembly of 1150 may have the same or similar size or configuration to those noted above except that is made of a semi-rigid material as opposed to a rigid material. The term "generally rigid" refers to both rigid and semi-rigid materials, whereas "substantially rigid" refers to rigid materials. In this regard, the semi-rigid material acts to obviate the use of a back-up pad since the semi-rigid nature also serves to cushion as a backup pad. Semi-rigid materials for use in the body assembly 1150 may be like those described above except that their hardness and flexural properties are selected to reflect a certain amount of resiliency that would be consistent with providing a stiff surface during abrading yet be resiliently deformable to provide for some cushioning as might be provided by a back-up pad of the kinds noted above. For example, the semi-rigid body assembly 1150 may be made of a suitable elastomeric polyurethane material having a flexural modulus at 73 degrees F. between about 5,000 lbs./in$^2$ to about 10,000 lbs./in$^2$. Such elastomeric polyurethane material is commercially available. Examples of elastomeric polyurethane material providing such a range is Bayflex™ 5000 M and Bayflex™ 10000 M that are commercially available from Bayer MaterialScience LLC, Pittsburgh, Pa. Other suitable ranges may be provided for other suitable materials to provide a semi-rigid configuration to function as noted above. Also, the semi-rigid body assembly 1150 may have durometer readings in a range of from about 30 Shore A hardness to about 80 Shore A hardness. More typically, the hardness may be in a range of about 45 Shore A to about 60 Shore A. In this exemplary embodiment, the strip of loop material of the hook and loop system 1096 the attaching member 1082 is to be overmolded to the body assembly 1150 using the materials described above in regard to FIG. 10. It will be further appreciated that the temperatures, materials, and techniques for overmolding consistent with the overmolding described herein are within the purview of one of ordinary skill in the molding arts.

This present description may take on various modifications and alterations without departing from the spirit and scope. Accordingly, this present description is not limited to the above-described embodiments, but is to be controlled by limitations set forth in the following claims and any equivalents thereof. This present description also may be suitably practiced in the absence of any element not specifically disclosed herein. All patents and publications noted above, including any in the Background section are incorporated by reference into this document in total.

What is claimed is:

1. A conversion assemblage adapted for converting an attachment head of a pole sander, the conversion assemblage comprising:

a generally rigid body assembly including first and second major surfaces opposing each other, the first major surface defining a floor of a recess for receiving the attachment head of the pole sander, and the second major surface being generally flat and attachable to a surface modifying member;

a restraining strap for securing the conversion assemblage to the attachment head, the restraining strap having opposing first and second ends and a length between the first and second ends;

wherein a portion of the length of the strap extends between the first and second major surfaces wherein the generally rigid body assembly includes a top portion defining the first major surface and a bottom portion defining the second major surface, the bottom portion mated to the top portion, and further wherein the restraining strap extends between the top and bottom portions, the conversion assemblage further comprising:

a foam pad force absorbing member adhesively secured to the second major surface;

wherein the bottom portion separates the restraining strap from the foam pad force absorbing member.

2. The conversion assemblage of claim 1, wherein the generally rigid body assembly has an outer perimeter defining an area larger than an area defined by an outer perimeter of the attachment head.

3. The conversion assemblage of claim 1, wherein the generally rigid body assembly has an outer perimeter defining an area of about 50 to about 100% larger than an area defined by an outer perimeter of the attachment head.

4. The conversion assemblage of claim 1, wherein the generally rigid body assembly has opposing openings in the floor, and further wherein the restraining strap passes through the openings for securing the conversion assemblage to the attachment head.

5. The conversion assemblage of claim 1, further including a force absorbing member adhesively secured to the second major surface.

6. The conversion assemblage of claim 5, wherein the force absorbing member comprises a foam pad.

7. The conversion assemblage of claim 5, wherein the force absorbing member has a thickness from about 62.5 to about 250 mil and a density of about 2 to about 3 $lb/ft^3$, and further wherein the generally rigid body assembly has a density of about 0.35 $lb/in^3$ to 0.65 $lb/in^3$.

8. The conversion assemblage of claim 5, wherein the force absorbing member has a Shore A hardness of about 30 to about 60.

9. The conversion assemblage of claim 5, further including an attaching member comprising first and second opposing major surfaces, the first major surface adhesively secured to the force absorbing member, and the second major surface comprising a first releasable mechanical connection mechanism.

10. The conversion assemblage of claim 9, wherein the first releasable mechanical connection mechanism comprises a loop system adapted to secure to a hook system of the surface modifying member.

11. The conversion assemblage of claim 9, the attaching member comprising opposing longitudinal end portions, each longitudinal end portion adapted to wrap around the ends of the force absorbing member and the generally rigid body assembly.

12. The conversion assemblage of claim 9, further comprising the surface modifying member having first and second opposing major surfaces, the first major surface comprising a second releasable mechanical connection mechanism matable with the first releasable mechanical connection mechanism, and the second major surface comprising an abrasive layer.

13. The conversion assemblage of claim 12, wherein the second releasable mechanical connection mechanism comprises a hook system.

14. The conversion assemblage of claim 1, wherein the restraining strap is a first restraining strap, the conversion assemblage further comprising:

a second restraining strap for securing the conversion assemblage to the attachment head, the second restraining strap extending between the first and second major surfaces and separated from the foam pad force absorbing member by the bottom portion of the generally rigid body assembly;

wherein the generally rigid body assembly forms first and second pairs of opposing openings in the floor;

and further wherein the first restraining strap passes through the first pair of opposing openings and the second restraining strap passes through the second pair of opposing openings.

15. A pole sanding device comprising:

a pole sander comprising an attachment head mounted to an extension pole; and a conversion assemblage attached to the attachment head, the conversion assemblage comprising:

a generally rigid body assembly including first and second major surfaces opposing each other, the first major surface defining a floor of a recess for receiving the attachment head of the pole sander, and the second major surface being generally flat and attachable to a surface modifying member;

a restraining strap for securing the conversion assemblage to the attachment head, the restraining strap having opposing first and second ends and a length between the first and second ends;

wherein a portion of the length of the strap extends between the first and second major surfaces wherein the generally rigid body assembly includes a top portion defining the first major surface and a bottom portion defining the second major surface, the bottom portion mated to the top portion, and further wherein the restraining strap extends between the top and bottom portions, the conversion assemblage further comprising:

a foam pad force absorbing member adhesively secured to the second major surface;

wherein the bottom portion separates the restraining strap from the foam pad force absorbing member.

16. The pole sanding device of claim 15, wherein the generally rigid body assembly has an area larger than that of the attachment head.

17. The conversion assemblage of claim 15, wherein the generally rigid body assembly has an area of about 50 to about 100% larger than that of the attachment head.

18. A method of converting a pole sander, comprising:

providing a pole sander comprising an attachment head mounted to an extension pole;

providing a conversion assemblage comprising:

a generally rigid body assembly including first and second major surfaces opposing each other, the first major surface defining a floor of a recess for receiving the attachment head of the pole sander, and the second major surface being generally flat and attachable to a surface modifying member, a restraining strap for securing the conversion assemblage to the attachment head, the restraining strap having opposing first and second ends and a length between the first and second ends, wherein a portion of the length of the strap extends between the first and second major surfaces wherein the generally rigid body assembly includes a top portion defining the first major surface and a bottom portion defining the second major surface, the bottom portion mated to the top portion, and further wherein the restraining strap extends between the top and bottom portions, the conversion assemblage further comprising:

a foam pad force absorbing member adhesively secured to the second major surface;

wherein the bottom portion separates the restraining strap from the foam pad force absorbing member; and attaching the conversion assemblage to the attachment head, including wrapping a section of the length of the strap over the attachment head.

19. The method of claim 18, wherein the generally rigid body assembly has an area larger than that of the attachment head.

* * * * *